US005602712A

United States Patent [19]

Daifuku et al.

[11] Patent Number: 5,602,712

[45] Date of Patent: Feb. 11, 1997

[54] CONTACT CHARGING METHOD AND APPARATUS

[75] Inventors: Hideharu Daifuku, Akishima; Yoshitomo Masuda, Hamura; Kinya Suzuki, Kodaira; Hiroshi Harashima, Kodaira; Hiroshi Kaneda, Kodaira; Yoshio Takizawa, Kodaira; Takahiro Kawagoe, Tokorozawa, all of Japan

[73] Assignee: Bridgestone Corporation, Tokyo, Japan

[21] Appl. No.: 951,117

[22] Filed: Sep. 25, 1992

[30] Foreign Application Priority Data

| | | | |
|---|---|---|---|
| Sep. 27, 1991 | [JP] | Japan | 3-276704 |
| Sep. 27, 1991 | [JP] | Japan | 3-276705 |
| Sep. 27, 1991 | [JP] | Japan | 3-276706 |
| Oct. 25, 1991 | [JP] | Japan | 3-306491 |
| Aug. 5, 1992 | [JP] | Japan | 4-229168 |

[51] Int. Cl.[6] ..... G03G 13/05

[52] U.S. Cl. ..... 361/225; 361/222; 492/53; 399/176

[58] Field of Search ..... 355/219–222, 355/274, 275; 361/220–225, 230; 430/35, 56, 58, 902; 118/644, 661; 492/53, 56, 16–17, 28, 48

[56] References Cited

U.S. PATENT DOCUMENTS

| | | | |
|---|---|---|---|
| 3,684,364 | 8/1972 | Schmidlin . | |
| 4,328,280 | 5/1982 | Huizinga et al. | 428/411 |
| 4,727,453 | 2/1988 | Ewing | 361/225 |
| 4,959,688 | 9/1990 | Koitabashi . | |
| 5,008,706 | 4/1991 | Ohmori et al. | 355/219 |
| 5,017,965 | 5/1991 | Hashimoto et al. | 355/219 |
| 5,076,201 | 12/1991 | Nishio et al. | 118/653 |
| 5,089,851 | 2/1992 | Tanaka et al. | 355/219 |

FOREIGN PATENT DOCUMENTS

| | | |
|---|---|---|
| 0272072 | 6/1988 | European Pat. Off. . |
| 0280542 | 8/1988 | European Pat. Off. . |
| 0323252 | 7/1989 | European Pat. Off. . |
| 0329366 | 8/1989 | European Pat. Off. . |
| 0367203 | 5/1990 | European Pat. Off. . |
| 0385462 | 9/1990 | European Pat. Off. . |
| 0406834 | 1/1991 | European Pat. Off. . |

OTHER PUBLICATIONS

Conference Record of the 1986 IEEE Industry Applications Society Annual Meeting Part II, Denver Colorado, Sep. 28–Oct. 3, pp. 1272–1276.

Patent Abstracts of Japan, vol. 12, No. 295 & JP–A–63 070 258.

Patent Abstracts of Japan, vol. 15, No. 119 & JP–A–03 006 579.

Patent Abstracts of Japan, vol. 15, No. 176 & JP–A–03 038 664.

Patent Abstracts of Japan, vol. 14, No. 215 & JP–A–02 049 066.

Patent Abstracts of Japan, vol. 9, No. 182 & JP–A–60 052 870.

*Primary Examiner*—A. T. Grimley
*Assistant Examiner*—T. A. Dang
*Attorney, Agent, or Firm*—Sughrue, Mion, Zinn, Macpeak & Seas

[57] ABSTRACT

An object, typically photoconductor drum is electrically charged by placing a contact charger member in abutment with the object to be charged and applying voltage between the contact charger member and the object. Charging is effected by properly controlling the capacitance of the contact charger member, the capacitance of the object, and the applied voltage. A sufficient charged potential is achieved through the application of a relatively low voltage, while preventing ozone generation.

19 Claims, 7 Drawing Sheets

CONTACT CHARGING METHOD AND APPARATUS

FIELD OF THE INVENTION

This invention relates to a contact charging method and apparatus suitable for use in electrophotographic machines such as copying machines and printers. More particularly, it relates to a contact charging method and apparatus capable of providing a sufficient charge potential through the application of a relatively low voltage while preventing ozone generation, thus achieving low power consumption and size reduction of the apparatus.

BACKGROUND OF THE INVENTION

The electrophotographic process used in copying machines involves first electrically charging the surface of a photoconductor uniformly, projecting an image to the photoconductor from an optical system for forming a latent image on the photoconductor while allowing charges to be removed from the portion of the photoconductor that is exposed to light, followed by toner application and transfer of the toner image to paper. For uniformly charging the photoconductor surface to a desired potential, most conventional electrophotographic machines such as copying machines use a corona discharge device having a wire electrode and a shield electrode. The corona charging process, however, suffers from several problems including (1) generation of ozone or the like as a result of corona discharge, (2) a high voltage of 4 to 8 kV applied to provide a high potential of 500 to 700 V on the photoconductor, (3) low charging efficiency in that only a few percents of the corona current is utilized in charging, and (4) contamination of the wire electrode with dust and debris.

In order to eliminate these problems, a contact charging method was proposed in which an charger member is contacted with an object to be charged for electrically charging the object without using a corona discharge device. The prior art method falls in the concept of contact charging in that electric charging is conducted with the charger member and the object to be charged held in contact, but exactly speaking, relies on the mechanism that the object to be charged is charged by effecting air discharge through a fine gap between the charger member and the object to be charged. Therefore, the prior art contact charging method could reduce ozone generation as compared with the use of a corona discharge device, but could not fully suppress ozone generation. The charging method essentially relying on air discharge undesirably requires an extremely high charging onset voltage of several hundreds of volts in accordance with Paschen's law relating to air discharge across a narrow gap. We found that the charging onset voltage or charging threshold was often as high as 600 to 750 V and a high voltage of −1300 to −1500 V should be applied to provide a charging potential of −600 V, for example.

The conventional contact charging method sometimes applies a DC voltage having an AC voltage overlapped in order to maintain the charge potential uniform. This undesirably produces boisterous high-frequency noises due to air discharge.

Known charger members used in the conventional contact charging method include rollers of conductive rubber having carbon or other conductive particles dispersed therein, and such rollers covered with nylon, or the like. These charger members are given a necessary conductivity to continuously charge positive or negative an object to be charged. In the case of contact charging, however, consistent charging is not always achieved even if the charger member has a predetermined conductivity. For charger members having the same conductivity, for example, images bearing black peppers and fogs due to uneven charging appear with some members, but not with other members. This is a problem inherent to the contact method, not encountered in the corona discharge system. In addition, heretofore proposed charger members of natural rubber, butyl rubber, epichlorohydrin, silicone rubber or the like include many unknown factors in their behavior and are insufficient in charging performance and stability.

SUMMARY OF THE INVENTION

An object of the present invention is to provide a new and improved contact charging method and apparatus capable of completely eliminating ozone generation. Another object of the present invention is to provide a new and improved contact charging method and apparatus capable of completely eliminating the generation of high-frequency noise associated with a combination of a DC voltage and an overlapping AC voltage. A further object of the present invention is to provide a new and improved contact charging method and apparatus capable of providing a sufficiently high charged potential through the application of a relatively low voltage and at acceptable charging efficiency.

In connection with a process of electrically charging a member by placing a contact charger member in abutment with the object to be charged and applying voltage therebetween, we have found that by optimizing the capacitance of the contact charger member, the capacitance of the object to be charged, and the applied voltage, charging can be carried out in a direct charging mode, e.g., direct charge transfer and triboelectric charging without incurring air discharge. Then no ozone generates and a sufficient charge potential is available through the application of a relatively low voltage.

In order to minimize the influence to a human body, electrophotographic machines such as copying machines are desired to suppress ozone generation as low as possible. Since the prior art charging method utilizing air discharge, which is either of the corona discharge type or of the contact electrification type, always generates ozone as a by-product due to air discharge, it is impossible to completely suppress ozone generation. Making investigations on the contact electrification method free of corona discharge, we sought for optimum conditions under which electric charging is carried out with a relatively low applied voltage without inducing air discharge.

Referring to FIG. 1, there is schematically illustrated a contact charger arrangement in which a contact charger member in the form of a roll 1 is placed in abutment with an object to be charged in the form of a photoconductor drum 2 consisting of a cylindrical metal base **2*b* and a covering photoconductor layer 2*a*. A power supply 3 applies a voltage between the contact charger member 1 and the photoconductor 2 for thereby charging the photoconductor 2. With respect to the voltage applied across the microscopic gap between the contact charger member 1 and the photoconductor 2, an electrical model is given as the schematic view of FIG. 2. The contact charger member 1 is spaced distance $d_0$ (μm) from the photoconductor 2**. When a voltage $V_T$ is externally applied, there develops a voltage $V_0$ across the gap $d_0$ which is represented by the following formula (2).

$$V_0 = \frac{d_0}{d_0 + \frac{\epsilon_0}{C_1} + \frac{\epsilon_0}{C_2}} V_T \quad (2)$$

In the formula, $C_1$ is the capacitance (or electrostatic capacity) of contact charger member 1 (F/μm²), $C_2$ is the capacitance of photoconductor 2 (F/μm²), $\epsilon_0$ is the dielectric constant of vacuum equal to $8.854\times 10^{-18}$ F/μm, $d_0$ is the gap between contact charger member 1 and photoconductor 2 (μm), $V_0$ is the voltage across gap $d_0$ (V), and $V_T$ is the applied voltage (V).

It is to be noted that $C_1$, $C_2$, $\epsilon_0$, $d_0$, $V_0$, and $V_T$ have the same meanings as above throughout the specification.

The discharging phenomenon across gap $d_0$ is derived from Paschen's law and discharge breakdown voltage $V_p$ (V) is approximated by equation (3).

$$V_p = 312 + 6.2\, d_0 \quad (3)$$

Equation (3) is drawn together with Paschen's curve in the graph of FIG. 3. In FIG. 3, gap $d_0$ is on the abscissa and the voltage $V_p$ or $V_0$ is on the ordinate. Curve A is Paschen's curve. Curves B to E are curves showing how $V_0$ varies with a parameter $(\epsilon_0/C_1+\epsilon_0/C_2)$ for $V_T$=1000 V, more particularly, curves B, C, D and E are $V_0$ associated with $(\epsilon_0/C_1+\epsilon_0/C_2)$=1, 10, 20, and 50, respectively.

In FIG. 3, discharge occurs where there is an intersection between Paschen's curve A and another curve. Then, the following quadratic equation (4) relating to $d_0$ wherein $V_0=V_p$ has a real solution.

$$\frac{d_0}{d_0 + \frac{\epsilon_0}{C_1} + \frac{\epsilon_0}{C_2}} \times V_T = 312 + 6.2\, d_0 \quad (4)$$

On the other hand, the condition under which no discharge occurs is (a) that quadratic equation (4) has no real solution, that is, the following discrimination equation is negative or (b) that $d_0$ is 0 or lower even when quadratic equation (4) has a real solution. Condition (a) or (b) is mathematically expressed as follows.

(a) Quadratic equation (4) has no real solution.

$$\left\{ 312 + 6.2\left(\frac{\epsilon_0}{C_1} + \frac{\epsilon_0}{C_2}\right) - V_T \right\}^2 - 4\times 6.2\times 312\left(\frac{\epsilon_0}{C_1} + \frac{\epsilon_0}{C_2}\right) < 0 \quad (5)$$

This is modified to:

$$\left| 312 + 6.2\left(\frac{\epsilon_0}{C_1} + \frac{\epsilon_0}{C_2}\right) - V_T \right| - 87.96\sqrt{\left(\frac{\epsilon_0}{C_1} + \frac{\epsilon_0}{C_2}\right)} < 0 \quad (6)$$

(b) Quadratic equation (4) has a real solution and $d_0$ is 0 or lower.

$$\left\{ 312 + 6.2\left(\frac{\epsilon_0}{C_1} + \frac{\epsilon_0}{C_2}\right) - V_T \right\}^2 - 4\times 6.2\times 312\left(\frac{\epsilon_0}{C_1} + \frac{\epsilon_0}{C_2}\right) \geqq 0 \quad (7)$$

and $$312 + 6.2\left(\frac{\epsilon_0}{C_1} + \frac{\epsilon_0}{C_2}\right) - V_T \geqq 0 \quad (8)$$

Namely, $$V_T \leqq 312 + 6.2\left(\frac{\epsilon_0}{C_1} + \frac{\epsilon_0}{C_2}\right) - 87.96\sqrt{\left(\frac{\epsilon_0}{C_1} + \frac{\epsilon_0}{C_2}\right)} \quad (9)$$

Accordingly, in order to prevent occurrence of discharge, contact charging should be carried out under the condition satisfying formula (6) or (9). As the condition under which no air discharge occurs in contact charging, we have derived formula (1) by combining formulae (6) and (9) together.

$$|V_T| < 312 + 6.2\left(\frac{\epsilon_0}{C_1} + \frac{\epsilon_0}{C_2}\right) + 87.96\sqrt{\left(\frac{\epsilon_0}{C_1} + \frac{\epsilon_0}{C_2}\right)} \quad (1)$$

It will be understood that $V_T$ in absolute form represents both positive and negative voltage application.

Carrying out a charging test under conditions meeting formula (1), we have found that acceptable charged potentials are provided with relatively low applied voltages without generating ozone at all as demonstrated in Examples which will be described later. The present invention is predicated on this finding.

Accordingly, the present invention in a first aspect provides a contact charging method comprising the steps of placing a contact charger member in abutment with an object to be charged and applying voltage between the contact charger member and the object for electrically charging the object. The capacitance of the contact charger member, the capacitance of the objet to be charged, and the applied voltage meet the relationship represented by formula (1).

Also in the first aspect, the present invention provides a contact charging apparatus for electrically charging an object, comprising a contact charger member disposed in abutment with a surface of the object to be charged, and means for applying voltage between the contact charger member and the object for electrically charging the object. The capacitance of the contact charger member, the capacitance of the object to be charged, and the applied voltage meet the relationship by formula (1).

We have also found that in charging an object by placing an charger member in abutment with the object to be charged and applying voltage therebetween, the object can be charged negative in a satisfactory stable manner by using the charger member having a less work function than the object. The object can be charged positive in a satisfactory stable manner by using the charger member having a greater work function than the object.

In a second aspect, the present invention provides an charger member for use in negatively or positively charging an object by placing the charger member in abutment with a surface of the object to be charged and applying voltage between the charger member and the object. When it is desired to charge the object negatively, at least a portion of the charger member which is in abutment with the object to be charged has a less work function than the object surface. When it is desired to charge the object positively, at least a portion of the charger member which is in abutment with the object to be charged has a greater work function than the object surface.

Also provided is a charging apparatus for electrically charging an object, comprising an charger member disposed in abutment with a surface of the object to be charged, and means for applying voltage between the charger member and the object for charging the object. The charger member used herein is as just defined. That is, the charger member has a less or greater work function than the object surface depending on whether the charge imparted to the object is negative or positive.

The term "work function" used herein refers to the minimum energy needed to remove an electron from a conductor or semiconductor crystal surface to vacuum immediately outside the surface, which can be determined from the energy threshold of photoelectron emission and contact potential.

Although the reason why charging performance is improved by adjusting the work function of an charger member is not well understood, we presume the following mechanism. In a contact charging process of carrying out charging of an object in abutment with an charger member, the charging ability is largely dictated by the degree of charge transfer at the contact interface between the charger member and the object to be charged. When the object is to be charged negative, for example, a junction allowing for easy electron transfer from the charger member to the object would improve charging performance. Since the work function is the minimum energy needed to remove an electron from a crystal surface to vacuum as defined above, such a junction may be established for the object to be charged negative if the charger member has a lower work function than the object. Then satisfactory charging performance is expectable. Inversely, when the object is to be charged positive, a reverse junction would be preferred. Then satisfactory charging performance is expectable if the charger member has a higher work function than the object.

Moreover, although the prior art contact charging method carries out charging of an object while holding an charger member in contact with the object to be charged, in an exact sense, this is an air discharge mechanism in which charging is carried out through a close gap between the charger member and the object. Namely, the essential charging mechanism underlying the prior art contact charging method is invariant from the conventional corona discharge method. For this reason, a satisfactory charged potential is not always obtained and ozone generation is not fully restricted. We have found that in the process of charging an object by placing an charger member in abutment with the object to be charged and applying voltage therebetween, if electric charges are directly injected into the object without air discharge, a satisfactory charged potential is obtained through the application of a relatively low voltage and ozone generation is minimized.

Seeking for a charger member capable of charging through the direct charge injection mode while minimizing the occurrence of air discharge, we made a charging test using various charger members. If the voltage at which an object starts charging when the voltage applied between the object and the charger member in abutment therewith is gradually increased from a low level, that is, charging onset voltage (to be referred to as "charging threshold", hereinafter) is 500 V or lower, a desirable charged potential is obtained with a significantly low applied voltage as compared with situations having a charging threshold in excess of 500 V. In addition, ozone generation is essentially nil, which suggests that charging is effected in a direct charge injection mode with no air discharge essentially taking place.

Based on these findings, the present invention in a third aspect provides an charger member for use in electrically charging an object by placing the charger member in abutment with the object to be charged and applying voltage between the charger member and the object wherein the charger member allows electric charges to be directly injected into the object without air discharge. Preferably, the charger member has a charging threshold (above which charging becomes possible) of up to 500 V as expressed in the applied voltage.

Truly, charging by the charger member having a charging threshold of up to 500 V as expressed in the applied voltage is not by way of air discharge, but in the direct charge injection mode, that is, by injecting electric charges directly into the object. In accordance with Paschen's law relating to air discharge, the threshold above which charging takes place by way of air discharge is in the range of 600 to 750 V, that is, no charging by way of air discharge takes place below this threshold. Then a charging threshold of 500 V or lower ensures that charging takes place in the direct charge injection mode, but not in the air discharge mode.

Continuing further investigations on an charger member for use in electrically charging an object by placing the charger member in abutment with the object to be charged and applying voltage therebetween, we have found that charging performance is improved and stabilized by distributing a conductive polymer such as polyaniline and polypyrrole at the abutment with the object to be charged so that the conductive polymer may participate in charging.

Therefore, in a fourth aspect, the present invention provides a charger member for use in electrically charging an object by placing the charger member in abutment with the object to be charged and applying voltage between the charger member and the object wherein a conductive polymer is distributed at the abutment with the object.

Although the reason why charging performance is improved by distributing a conductive polymer at the abutment of the charger member with the object is not well understood, we presume as follows. Once an object to be charged, typically photoconductor is charged using a charger member, the object and the member are separated off, during which they tend to maintain a differential potential based on the respective work functions which has been established in the contact state, giving rise to a charge escape problem. Then some charges, once transferred to the object, would not effectively participate in charging of the object. A conductive polymer seems effective in restraining such charges from running away. Then the arrangement of the conductive polymer at the abutment of the charger member with the object allows the once transferred charges to be effectively utilized in charging of the object, resulting in improved charging performance.

We have further found that a satisfactory charged potential is obtained with a relatively low applied voltage and stable charging performance is achieved when at least a portion of the charger member which is in abutment with the object to be charged is formed from a polyurethane base compound having a volume resistivity of $10^4$ to $10^{12}$ Ω.cm.

Therefore, in the fourth aspect, the present invention also provides a charger member for use in electrically charging an object by placing the charger member in abutment with the object to be charged and applying voltage between the charger member and the object wherein at least a portion of the charger member which is in abutment with the object to be charged predominantly comprises a polyurethane having a volume resistivity of $10^4$ to $10^{12}$ Ω.cm.

Although the reason why a polyurethane base compound having a volume resistivity adjusted to the range of $10^4$ to $10^{12}$ Ω.cm exerts improved charging ability is not well understood, we presume as follows. In the case of a polyurethane having a lower volume resistivity, electric charges necessary for charging will migrate to the object during contact thereof with the polyurethane, but much charges will escape from the object upon separation of the polyurethane from the object, resulting in less charges remaining on the object. On the other hand, a higher volume resistivity beyond the above-defined range will restrain transfer of charges necessary for charging. Then the above-defined volume resistivity range not only allows sufficient charges to be transferred to the object for charging, but also prevents the once transferred charges from escaping away upon removal of the charger member from the object, thus exerting improved charging behavior.

In this way, the contact charging method and apparatus according to the present invention are designed to carry out charging in a direct charging mode while excluding discharge charging and are thus successful in restraining ozone generation, providing a sufficiently high charged potential with a relatively low applied voltage, and contributing to a reduction of power consumption, apparatus size, and noise.

BRIEF DESCRIPTION OF THE DRAWINGS

The above and other objects, features and advantages of the present invention will be more fully understood by reading the following description taken in conjunction with the accompanying drawings.

DETAILED DESCRIPTION OF THE INVENTION

Figure 1:
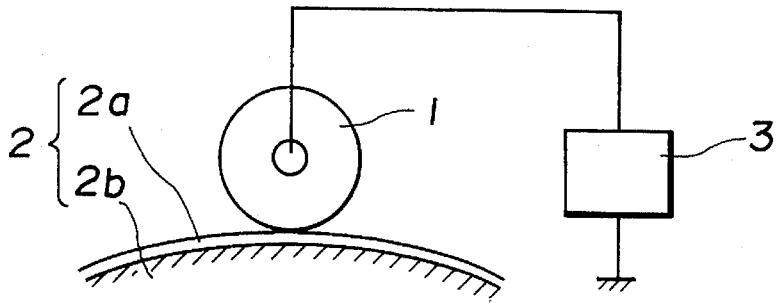
FIG. 1 schematically illustrates a contact charging system according to the present invention.
Figure 2:
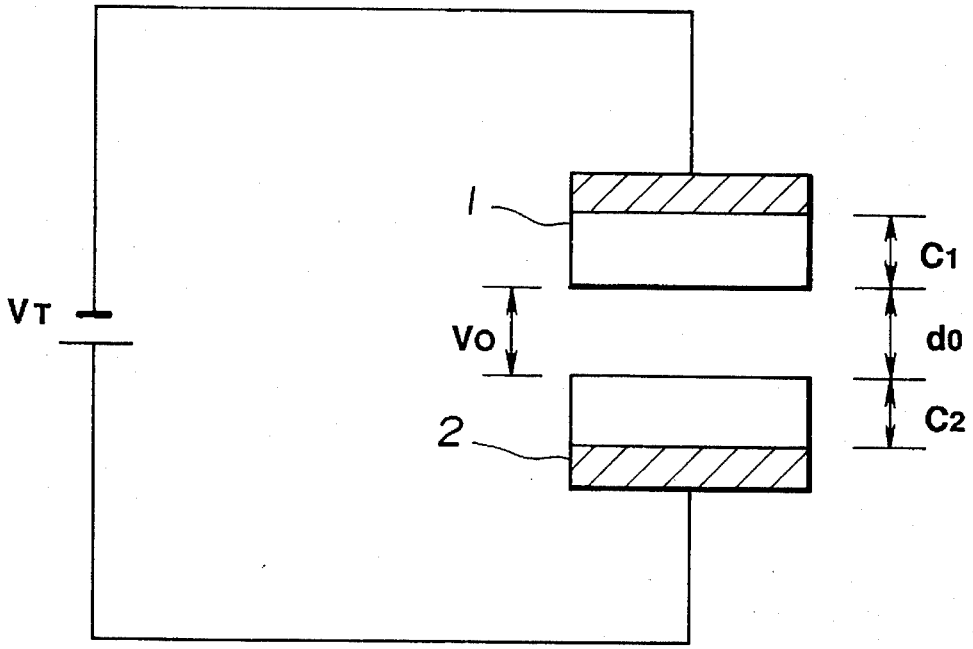
FIG. 2 schematically illustrates an electrical model representative of the contact charging system according to the present invention.
Figure 3:
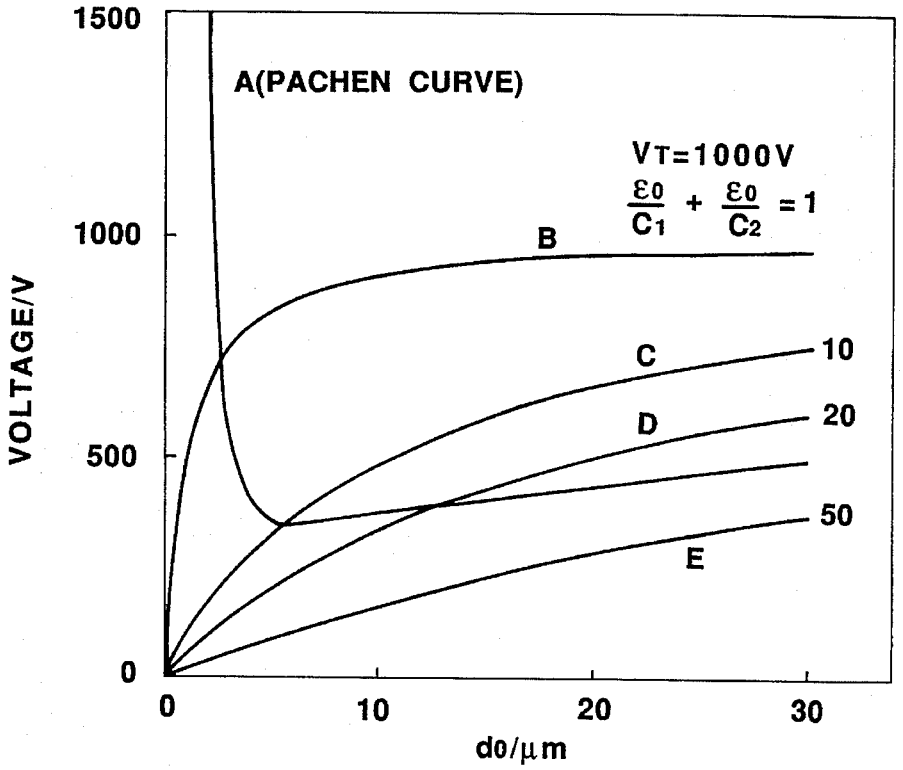
FIG. 3 is a breakdown voltage vs gap distance graph for explaining the contact charging system according to the present invention.

The contact charging method and apparatus according to the first aspect of the present invention are to electrically charge an object in a contact charging manner. Referring to FIG. 1, a contact charger member in the form of a roll 1 is placed in abutment with an object to be charged in the form of a photoconductor drum 2 consisting of a cylindrical metal base 2*b* and a covering photoconductor layer 2*a*. A power supply 3 applies a voltage between the contact charger member 1 and the object 2 for thereby charging the object 2. The capacitance of the contact charger member 1, the capacitance of the object to be charged 2, and the applied voltage meet the relationship represented by formula (1).

$$|V_T| < 312 + 6.2\left(\frac{\epsilon_0}{C_1} + \frac{\epsilon_0}{C_2}\right) + 87.96\sqrt{\left(\frac{\epsilon_0}{C_1} + \frac{\epsilon_0}{C_2}\right)} \quad (1)$$

$C_1$: the capacitance of the contact charger member ($F/\mu m^2$), $C_2$: the capacitance of the object ($F/\mu m^2$), $V_T$: the applied voltage (V), and $\epsilon_0$: the dielectric constant of vacuum equal to $8.854\times10^{-18}$ F/μm.

Figure 4:
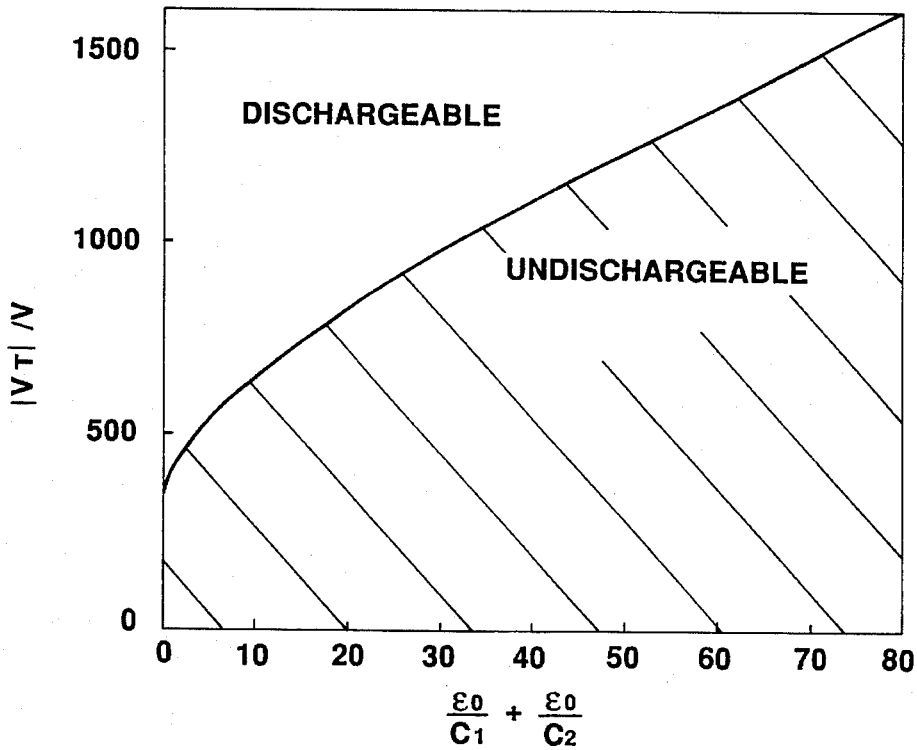
FIG. 4 is another graph for explaining the contact charging system according to the present invention.

The condition represented by formula (1) is diagrammatically shown in FIG. 4 wherein $(\epsilon_0/C_1+\epsilon_0/C_2)$ is on the abscissa and $V_T$ is on the ordinate. The shaded region is a region satisfying formula (1) where no discharge takes place. The blank region outside the shaded region is a region where discharge can take place. The present invention carries out charging within the shaded region of FIG. 4 through a proper choice of the capacitance of the contact charger member 1, the capacitance of the object to be charged 2, and the applied voltage. It will be understood that the boundary line between the dischargeable and undischargeable regions in FIG. 4 represents the charging threshold (or charging onset voltage) for discharge charging to take place.

The contact charging method and apparatus according to the present invention carries out charging under the conditions represented by formula (1). As long as the capacitance $C_1$ of the contact charger member, the capacitance $C_2$ of the object to be charged, and the applied voltage $V_T$ meet formula (1), no other limits need be added to them. Particularly when the invention is applied to electrophotographic machines and electrophotographic printers wherein the object should be charged to a potential as high as several hundreds of volts, therefore, $(\epsilon_0/C_1+\epsilon_0/C_2)$ is preferably 10 or higher (see FIG. 4).

The capacitance $C_1$ of the contact charger member is determined in accordance with the capacitance $C_2$ of the object to be charged so as to meet formula (1), and is preferably $1\times10^{-21}$ to $1\times10^{-16}$ $F/\mu m^2$, more preferably $1\times10^{-20}$ to $1\times10^{-17}$ $F/\mu m^2$.

Wide latitude is allowed for the shape, structure, material and other factors of the contact charger member used in the present invention. Such factors may be properly selected in accordance with a particular use or necessary charged potential. For example, the member may be shaped in roller, brush, plate and other forms, with the roller being preferred. It may have a monolayer structure or a multilayer structure including two or more layers.

Figure 5:
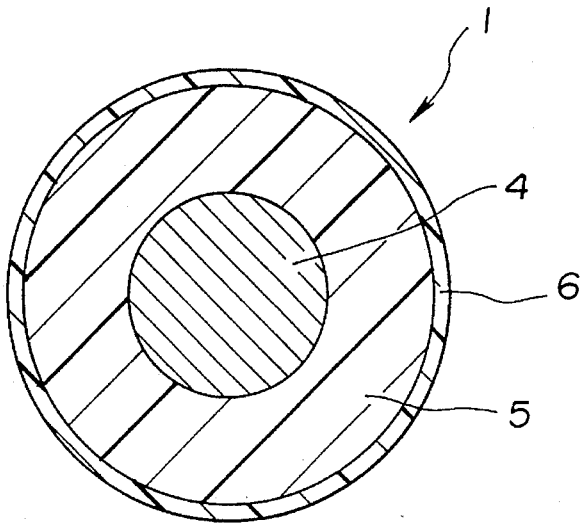
FIG. 5 is a cross section of one exemplary contact charger member according to the present invention.

One preferred example of the contact charger member used herein is shown in FIG. 5 as a roller-shaped member. The contact charger member 1 includes a cylindrical core 4 of a conductive material such as metal, a conductive elastomer layer 5 enclosing the core 4, and a surface layer 6 of a resistance modifying material and/or dielectric material covering the layer 5.

In general, the conductive elastomer and surface layers 5 and 6 are formed from conductive materials, semiconductor materials, synthetic resin materials, rubber materials or the like. Examples of the useful conductive materials and semiconductor materials include graphite powder, conductive carbon powder, acetylene black, metal compound semiconductors such as $TiO_2$ and $SnO_2$, dyes such as aniline black and conductive polymers such as polyaniline, polyacetylene, polypyrrole, polythiophene and polyacene. Exemplary synthetic resins include polyurethane, polyolefins, polystyrene, polyesters, acrylics, and polyamides, and exemplary rubber materials are natural rubber, modified natural rubber, styrene-butadiene rubber, polybutadiene, isoprene rubber, acrylonitrilebutadiene rubber, chloroprene rubber, ethylene-propylene rubber, ethylene-propylene terpolymer, butyl rubber, acrylic rubber, Hypalon®, silicone rubber, fluoride rubber, polysulfide rubber, urethane rubber, epichlorohydrin rubber, etc. Preferred among others are polyurethane, polyamides, polyesters, and similar synthetic resins, and styrenebutadiene rubber, polybutadiene, isoprene rubber, epichlorohydrin rubber, natural rubber and similar rubbers. Composite materials of such polymers mixed and dispersed with conductive or semiconductor materials as mentioned above or such polymers alone may be used to form the charger member. The polymers may be used as such or in porous form. It is also preferred to add high dielectric constant materials such as $BaTiO_3$ and polyvinylidene fluoride to polymers to control the capacitance thereof. All these materials can be used to form any contact charger member other than the structure shown in FIG. 5, for example, brush or plate-shaped contact charger members.

Preferably, the contact charger member has an electric resistance of area of $10^3$ to $10^{14}$ Ω.cm, more preferably $10^6$ to $10^{10}$ Ω.cm at its surface which comes in contact with an object to be charged.

The electric resistance of area is represented by the following formula.

$$R \cdot S \text{ (= electric resistivity of area)} = \rho \cdot L$$

wherein R is an electric resistance (Ω), L is a length (cm), S is an area ($cm^2$), and ρ is a volume resistivity (Ω.cm).

In the practice of the invention, the contact charger member is abutted against the object to be charged and voltage is applied therebetween for charging the object. The voltage application includes both application of a DC voltage alone and application of a DC voltage and an overlapping AC voltage. In the former case, the DC voltage applied may be of any desired value which is selected from the range of applied voltage $V_T$ that is permitted by formula (1) in accordance with the capacitances of the charger member and the object. In the event wherein a DC voltage combined with an overlapping AC voltage is applied, the DC voltage applied is lower than the maximum applied voltage $V_T$ that is permitted by formula (1) in accordance with the capacitances of the charger member and the object. As long as the overlapping of AC voltage does not induce air discharge, an AC voltage of any amplitude and frequency may be overlapped. Preferred are AC voltages having an amplitude of 100 to 2500 V and a frequency of 1 to 1500 Hz, more preferably an amplitude of 500 to 2000 V and a frequency of 10 to 700 Hz.

The charging apparatus using a charger member in the contact charging system according to the second aspect of the invention is characterized in that the work function of the charger member is optimized in accordance with the work function of an object to be charged.

Figure 6:
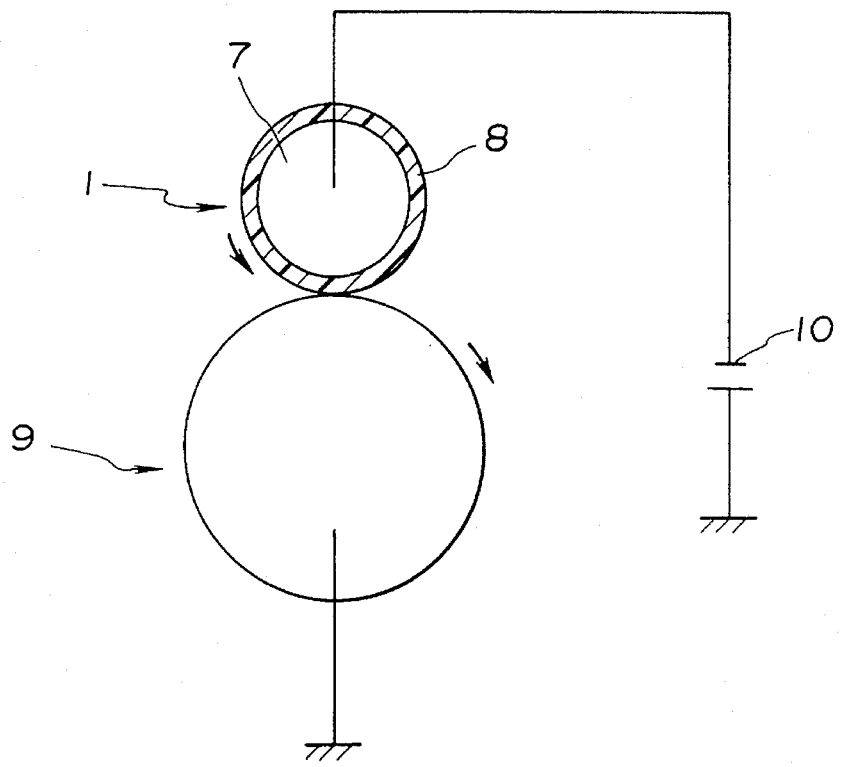
FIG. 6 schematically illustrates a charging apparatus using a charger member according to the present invention.

Referring to FIG. 6, a charger member is illustrated together with an overall contact charging system. The charger member 1 is shown as a roller comprising a cylindrical base 7 including a metal core (not shown) and a skin layer 8 covering the outer periphery of the base 7. The charger member 1 is placed in tangential contact with an object to be charged in the form of a photoconductor drum 9. A power supply 10 applies voltage between the charger member 1 and the drum 9 for charging the drum 9. The charger member 1 and the drum 9 are rotating in opposite directions during charging so that the drum 9 is electrically charged over the entire surface. This charging apparatus may be incorporated in an electrophotographic machine such as a copying machine, generally by combining it with developing, transfer and cleaning units.

When it is desired to charge the object or drum 9 negative, the charger member 1 should have a less work function than the object 9. Inversely, when it is desired to charge the object or drum 9 positive, the charger member 1 should have a higher work function than the object 9. Such a work function is available by a proper choice of the material of which the charger member is formed. Preferably, a choice is made such that the differential work function between the charger member and the object is 0.05 eV or more, especially 0.1 eV or more.

The work function of the charger member 1 is usually adjusted by forming the skin layer 8 although the skin layer 8 may be omitted if the cylindrical base 7 meets the required work function. However, it is preferred, not necessarily, to form the skin layer 8 on the cylindrical base 7 even when the base 7 meets the requirement because the benefits of preventing contamination of the charger member 1 and pinhole leak are obtained.

The material of which the cylindrical base 7 of the charger member 1 is formed may be selected from those commonly used in charger members of the conventional contact charging system, for example, polyurethane and other synthetic resins having dispersed therein conductive particles of carbon black, carbon, graphite, aniline black, metal or the like or similarly compounded rubbers.

The skin layer 8 is generally formed of a composition comprising a matrix polymer and a filler. The work function of this composition has a composite value of both the components. By a proper choice of these components, the work function is adjusted as desired. Since the work function of the charger member 1 is determined relative to the work function of the object 9 to be charged, the filler and matrix polymer forming the skin layer 8 may be properly selected in accordance with the work function of the object 9 and depending on whether the object 9 is to be charged negative or positive. Examples of the filler and matrix polymer are given below.

For charging the object 9 negative, exemplary fillers include conductive polymers such as polyaniline, carbon black such as SAF (super abrasion furnace), FEF (fast extrusion furnace), SRF (semi-reinforcing furnace), FT (fine thermal), ink carbon, acetylene black, and Ketjen Black, graphite, anti-aging agents such as N,N'-di-β-naphthyl-p-phenylenediamine (DNPD), metal oxides such as Sb-doped $SnO_2$, undoped $SnO_2$, Sb-doped $TiO_2$ and ZnO, and dyes such as aniline black. Exemplary matrix polymers include resins such as nylon, polycarbonate, polystyrene, polyethylene, polypropylene, polyvinyl alcohol, polyvinyl chloride, chlorinated polyethylene, phenolics, acrylics, styrene-butadiene copolymers, and ethylene-vinyl acetate copolymers, and rubbers such as urethane, epichlorohydrin, butadiene, silicone, chloroprene rubbers and natural rubber.

For charging the object 9 positive, exemplary fillers include polyvinyl carbazole, diphenyl guanidine (DPG), 2-mercaptobenzimidazole (MB), and 2-mercaptomethylbenzimidazole (MMB), and metal oxides such as MgO and ZnO. The matrix polymers are the same as the resins and rubbers exemplified above.

The skin layer 8 may be formed, for example, by dissolving the matrix polymer in a suitable solvent, dispersing the filler therein, and dipping the cylindrical base 7 in the dispersion, followed by drying. As long as it has a desired work function, the skin layer 8 is not limited in thickness. Preferably it is up to 300 μm thick. The amount of the filler added is not particularly limited and may be properly selected as long as the skin layer 8 has a desired work function relative to the work function of the object 9.

As previously described, the work function is determinable from the contact potential and threshold of photoelectron emission. More particularly, the work functions of a charger member and an object can be determined by scanning them with ultraviolet radiation having an excitation energy varying from a low to high level, and detecting photoelectrons emitted from their surfaces due to photoelectric effect, the energy at the onset of photoelectron emission giving the work function.

The charger member and charging apparatus according to the second aspect of the invention is such that the object may be charged in an acceptable stable manner in accordance with the contact charging system by controlling the work function of the charger member relative to the object. Particularly, if charging takes place in such a manner that electric charges are directly injected into the object, not by way of air discharge, the object can be charged more effectively and stably. That is, a contact charging process of the direct charge injection mode is preferred.

More particularly, in the conventional contact charging method of charging an object while holding a charger member in contact with the object to be charged, in an exact sense, charging is carried out through air discharge across a close gap between the charger member and the object. We have found that more benefits can be derived from the process of charging an object by placing a charger member in abutment with the object to be charged and applying voltage therebetween, if electric charges are directly injected into the object without air discharge.

The means for carrying out charging in the direct charge injection mode without resorting to air discharge is as described in conjunction with the first aspect, that is, by placing a contact charger member in abutment with an object to be charged and applying voltage between the contact charger member and the object for electrically charging the object wherein the capacitance of the contact charger member, the capacitance of the object to be charged, and the applied voltage meet formula (1). Better results are obtained by combining the controlled work function of the charger member relative to the object with the controlled capacitances of the charger member and the object relative to applied voltage.

Although the reason why the benefits of the invention are enhanced by the direct charge injection mode is not well understood, we believe that unlike air discharge charging, in the case of direct charge injection mode charging, charge transfer is first initiated when the charger member contacts the object to be charged, and thus the junction between the charger member and the object plays an important role. Therefore, by improving the junction state between the charger member and the object, better results are available from the charger member and charging apparatus according to the present invention.

It is to be noted that the shape of the charger member used herein is not limited to the roll shape shown in FIG. 6. The charger member may have any desired shape which can be brought in secure abutment with the object to be charged, for example, plate, rectangular block, spherical and brush shapes. Most often, the charger member is of roll shape. The overall arrangement of the charging apparatus may be suitably modified in accordance with a particular use or the like.

Figure 7:
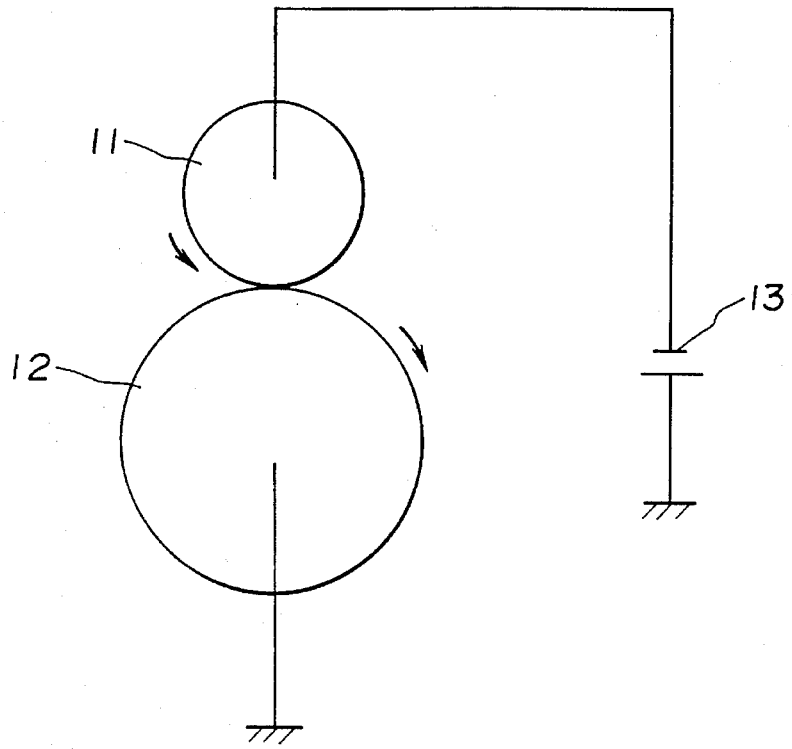
FIG. 7 illustrates a process of charging an object using a charger member according to the present invention.

The third aspect or direct charge injection mode of the present invention is now described. Referring to FIG. 7, a charger member 11 is used in electrically charging an object 12 by placing the charger member 11 in abutment with the object to be charged 12 and applying voltage between the charger member 11 and the object 12 from a power supply 13. The charger member 11 all allows electric charges to be directly injected into the object 12 without air discharge.

That charging takes place in the direct charge injection mode and not by way of air discharge is acknowledged by the empirical fact that when the voltage applied from the power supply 13 between the object 12 and the charger member 11 in abutment therewith is gradually increased from a low level, the voltage at which charging of the object starts is 500 V or lower. It is to be noted that this charging threshold is the absolute value of the applied voltage at which charge accumulation starts in the object 12 when the voltage applied between the charger member 11 and the object 12 is increased, and therefore the threshold may be of either positive or negative value.

The charging threshold is up to 500 V, preferably up to 400 V, more preferably up to 300 V, ideally a value of nearly 0 V as closely as possible. If the charging threshold exceeds 500 V, air discharge can occur so that as high voltage as required by the conventional charger members must be applied to achieve a satisfactory charged potential, giving off ozone.

The charger member may be formed of any desired material which allows for direct charge injection mode charging without air discharge, more particularly, having a charging threshold of up to 500 V. Preferred materials are synthetic resins such as polyurethane and various rubbers.

In one preferred embodiment of the charger member which is formed of polyurethane, the polyurethane is generally prepared by mixing a compound having at least two active hydrogen atoms, a compound having at least two isocyanate groups, and a catalyst, causing the mixture to expand if desired, and molding the mixture, followed by heat curing into a configured elastomer or foam which is ready for use as the charger member.

Examples of the compound having at least two active hydrogen atoms or polyhydroxyl compound include polyols commonly used in the preparation of conventional polyurethane elastomers and foams, for example, hydroxyl-terminated polyether polyols and polyester polyols and polyether-polyester polyols which are copolymers therebetween, as well as polymeric polyols obtained by polymerizing ethylenically unsaturated monomers in polyols. These ordinary polyols may be added in commonly used amounts.

Examples of the compound having at least two isocyanate groups or polyisocyanate compound include polyisocyanate compounds commonly used in the preparation of conventional polyurethane elastomers and foams, for example, tolylene diisocyanate (TDI), crude TDI, 4,4'-diphenyl-methane diisocyanate (MDI), crude MDI, aliphatic polyisocyanates having 2 to 18 carbon atoms, aromatic polyisocyanates having 6 to 15 carbon atoms, mixtures of such polyisocyanates, and modified ones such as prepolymers resulting from partial reaction with polyols. These polyisocyanates may be added in commonly used amounts.

Any additive may be added to the polyurethane if desired, examples of the additive including carbon black, carbon, graphite, metals and inorganic compounds. Preferably additives are added to the polyurethane so as to control its volume resistivity to $10^4$ to $10^{12}$ Ω.cm. These additives may be of spherical, whisker, flake, or irregular shape.

Where foam polyurethane is desired, there are optionally blended additional additives, for example, silicone foam stabilizers, flame retardants, organic fillers, inorganic fillers, pigments, plasticizers, and auxiliary foaming agents such as Freon® and methylene chloride.

Although the charger member of the invention is designed to carry out charging in the direct charge injection mode without resorting to the air discharge mode, involvement of some air discharge is permissible. However, for better results, air discharge should be avoided as completely as possible. It is preferred to carry out charging substantially solely in the direct charge injection mode. In order to avoid the concomitant air discharge, it is important that the charger member is in secure contact with the object to be charged during charging process or voltage application. Differently stated, the charging apparatus is arranged so as to insure continuous contact between the charger member and the object during charging process.

It is to be noted that the shape of the charger member used herein is not limited to the roll shape shown in FIG. 7. The charger member may have any desired shape which can be brought in secure abutment with the object to be charged, for example, plate, rectangular block, spherical and brush shapes. Most often, the charger member is of roll shape.

Described below is the fourth aspect of the present invention. The charger member of this embodiment has a conductive polymer disposed at the abutment of the member with an object to be charged.

Figure 8:
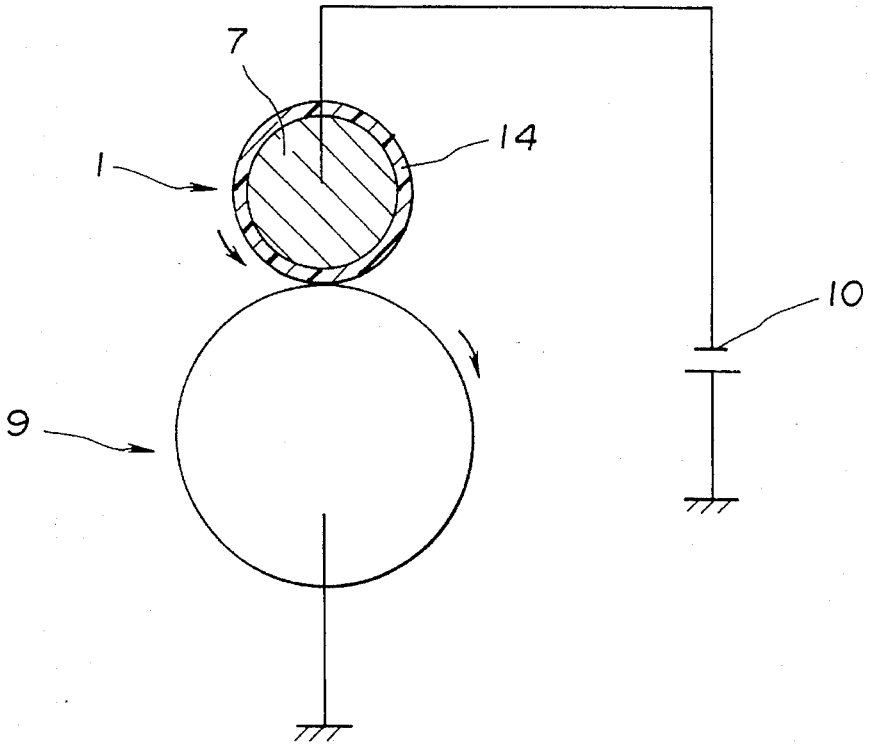
FIG. 8 schematically illustrates a charging apparatus using a charger member according to the present invention.

Referring to FIG. 8, a charger member is illustrated together with an overall contact charging system. The charger member 1 is shown as a roller comprising a cylindrical base 7 and a contact or abutment layer 14 comprised of a conductive polymer covering the outer periphery of the base 7. The charger member 1 is placed in tangential contact with an object to be charged in the form of a photoconductor drum 9. A power supply 10 applies voltage between the charger member 1 and the drum 9 for charging the drum 9. The charger member 1 and the drum 9 are rotating in opposite directions during charging so that the drum 9 is electrically charged over the entire surface.

Any desired conductive polymer may be used, for example, such as polyaniline, polypyrrole, polyfuran, polybenzene, polyphenylene sulfide, and derivatives thereof, with the polyaniline, polypyrrole and derivatives thereof being preferred.

The conductive polymer may be used in any desired form, for example, films consisting of the conductive polymer, shaped bodies obtained by consolidating particulate conductive polymer, composite bodies of particulate conductive polymer mixed with another polymer, and the like. In the case of the composite bodies, the amount of the conductive polymer blended preferably ranges from 5 to 70% by weight, especially from 10 to 50% by weight although the amount is not critical. The other polymer which can be used in admixture with the conductive polymer may be any polymer which can be loaded with the conducive polymer as a filler, for example, polyethylene, polystyrene, ethylenevinyl acetate copolymers, polycarbonate, polypropylene, polyvinyl alcohol, nylon, polyvinyl chloride, phenolic resins and acrylic resins.

The conductive polymer may be readily prepared by conventional chemical oxidative polymerization or electrolytic polymerization. In the former case, polyaniline is generally prepared through oxidative polymerization of aniline in an acidic aqueous solution containing an acid (e.g., hydrochloric acid, sulfuric acid, borofluoric acid, and acetic acid) and an oxidizing agent (e.g., ferric chloride, ammonium persulfate, potassium bichromate, and potassium permanganate). The resulting polyaniline is washed with water and alcohol, optionally doped or undoped appropriately, and then dried for use as the charger member.

Depending on the preparation technique, the conductive polymer is available in the form of particles as polymerized by the chemical oxidative polymerization technique or film as polymerized by the electrolytic polymerization technique. A choice may be made of the preparation technique depending on the desired form for subsequent use. Where the polymer is prepared in particulate form, especially when it is used in admixture with another polymer, the particles should preferably have as small size as possible because finer particles tend to induce uniform charging. The polymer is preferably polymerized into particles having a size of up to 100 μm, more preferably up to 10 μm, most preferably up to 1 μm.

The charger member of the invention is generally comprised of the cylindrical base 7 of a material having moderate conductivity (roll in the illustrated embodiment) and the annular cover 14 of a conductive polymer or a composite composition thereof joining to the base 7 as shown in FIG. 8. Of course, the overall charger member may be formed solely of a conductive polymer or a composite composition thereof. The base may be formed of metals, urethane or the like, with the urethane being preferred.

It is to be noted that the shape of the charger member used herein is not limited to the roll shape shown in FIG. 8. The charger member may have any desired shape, for example, plate, rectangular block, spherical and brush shapes. The charger member is often of roll shape and sometimes of brush shape.

In a further preferred embodiment, the charger member is such that at least a portion of the charger member which comes in contact with the object to be charged predominantly comprises a polyurethane having a volume resistivity of $10^4$ to $10^{12}$ Ω.cm. The structure of this charger member may be the same as that shown in FIG. 8.

Referring to FIG. 8 again, the charger member 1 includes a roll-shaped base 7 and a contact or abutment layer 14 covering the base 7. The contact layer 14 is formed of a polyurethane base composition having a volume resistivity of $10^4$ to $10^{12}$ Ω.cm. The charger member 1 is placed in contact with an object to be charged in the form of a photoconductor drum 9. A power supply 10 applies voltage between the charger member 1 and the drum 9 for charging the drum 9. The charger member 1 and the drum 9 are rotating in opposite directions during charging so that the drum 9 is electrically charged over the entire surface.

The polyurethane of which the portion 14 of the charger member which comes in abutment with the drum 9 is mainly formed is not particularly limited, but is generally prepared by mixing a compound having at least two active hydrogen atoms, a compound having at least two isocyanate groups, and a catalyst, causing the mixture to expand if desired, and molding the mixture, followed by heat curing into a configured elastomer or foam.

Examples of the compound having at least two active hydrogen atoms or polyhydroxyl compound include polyols commonly used in the preparation of conventional polyurethane elastomers and foams, for example, hydroxyl-terminated polyether polyols and polyester polyols and polyether-polyester polyols which are copolymers therebetween, as well as polymeric polyols obtained by polymerizing ethylenically unsaturated monomers in polyols. These ordinary polyols may be added in commonly used amounts. Examples of the compound having at least two isocyanate groups or polyisocyanate compound include polyisocyanate compounds commonly used in the preparation of conventional polyurethane elastomers and foams, for example, tolylene diisocyanate (TDI), crude TDI, 4,4'-diphenylmethane diisocyanate (MDI), crude MDI, aliphatic polyisocyanates having 2 to 18 carbon atoms, aromatic polyisocyanates having 4 to 15 carbon atoms, mixtures of such polyisocyanates, and modified ones such as prepolymers resulting from partial reaction with polyols. These polyisocyanates may be added in commonly used amounts.

A suitable filler or fillers are added to polyurethane so as to control its volume resistivity to $10^4$ to $10^{12}$ Ω.cm, preferably $10^5$ to $10^{11}$ Ω.cm, more preferably $10^6$ to $10^{11}$ Ω.cm. The filler may be any desired one which can produce a composite material having a specific volume resistivity. Examples of the filler include carbon, graphite, metals, other inorganic compounds and conductive polymers. These fillers may be of spherical, whisker, flake, or fibril shape. No limit is imposed on the size of the filler although a size of 1 nm to 100 μm, more preferably 1 nm to 10 μm, most preferably 1 nm to 1 μm is desired for even distribution.

The filler may be added to the polyurethane at any desired stage. One preferred approach is to add the filler to a polyol or compound having at least two active hydrogen atoms and then react it with a compound having at least two isocyanate groups. A particular type of polyol or isocyanate compound can achieve the above-defined volume resistivity without adding the filler. In such a case, it is unnecessary to add a filler.

Where foam polyurethane is desired, there are optionally blended additional additives, for example, silicone foam stabilizers, flame retardants, organic fillers, inorganic fillers, pigments, plasticizers, and auxiliary foaming agents such as Freon® and methylene chloride.

Often, the charger member of the invention is comprised of a cylindrical base of a conductive material such as metals and carbon (roll shape in FIG. 8) and a annular contact cover of polyurethane or a composite composition thereof joining to the base as shown in FIG. 8. Of course, the overall charger member may be formed solely of a polyurethane or a composite composition thereof. If desired, the contact layer of polyurethane or composite composition thereof may be covered with a polymeric coating of nylon, ethylene-vinyl acetate copolymer (EVA) or polyvinyl alcohol (PVA).

It is to be noted that the shape of the charger member used herein is not limited to the roll shape shown in FIG. 8. The charger member may have any desired shape which ensure close contact with the object to be charged, for example, plate, rectangular block, spherical and brush shapes.

EXAMPLE

Examples of the present invention are given below by way of illustration and not by way of limitation.

Example 1

A plate-shaped contact charger member was fabricated by adding 17% by weight of graphite powder to a polyurethane resin and forming the resin into a strip of 3 mm thick. This strip had an electric resistance of area of $8\times10^8$ Ω.cm$^2$ and a capacitance of $1.4\times10^{-19}$ F/μm$^2$. The strip was cut to a plaque of 20×20 mm. The plaque was attached to an aluminum substrate with a conductive double-side adhesive tape, obtaining the plate-shaped contact charger member.

Figure 9:
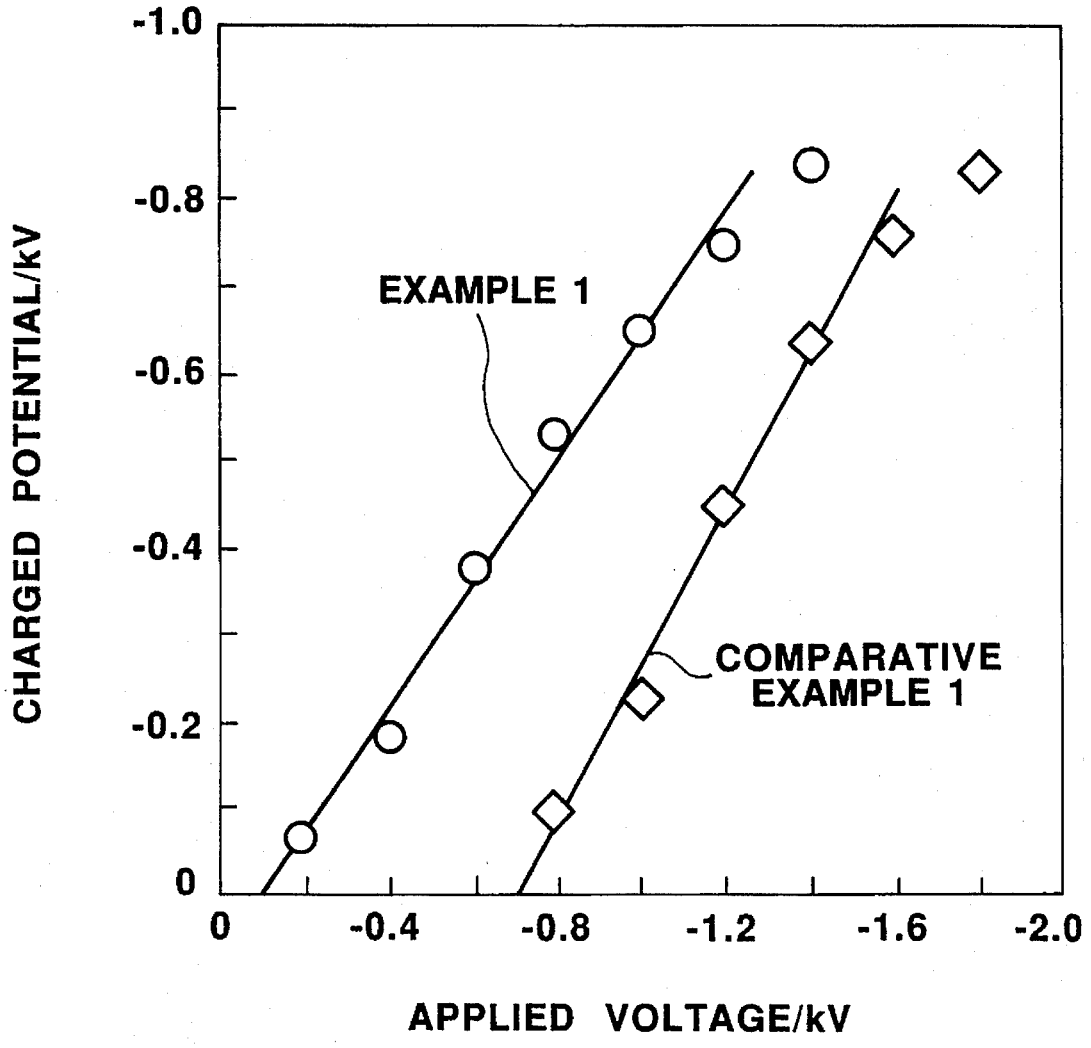
FIG. 9 is a diagram showing the results of a charging test in Example 1 and Comparative Example 1.

A charging test was carried out by placing this contact charger member on the strip side in abutment with an object to be charged in the form of an organic photoconductor drum having a capacitance of $1.1\times10^{-18}$ F/μm$^2$ and applying voltage between the member and the drum. The applied voltage was increased stepwise and the charged potential of the object was measured at each stage. FIG. 9 illustrates the charged potential relative to the applied voltage. In this charging test, $(\epsilon_0/C_1+\epsilon_0/C_2)$ was equal to 71.2 and the maximum permissible applied voltage $|V_T|$ was about 1496 V as calculated from formula (1).

Figure 10:
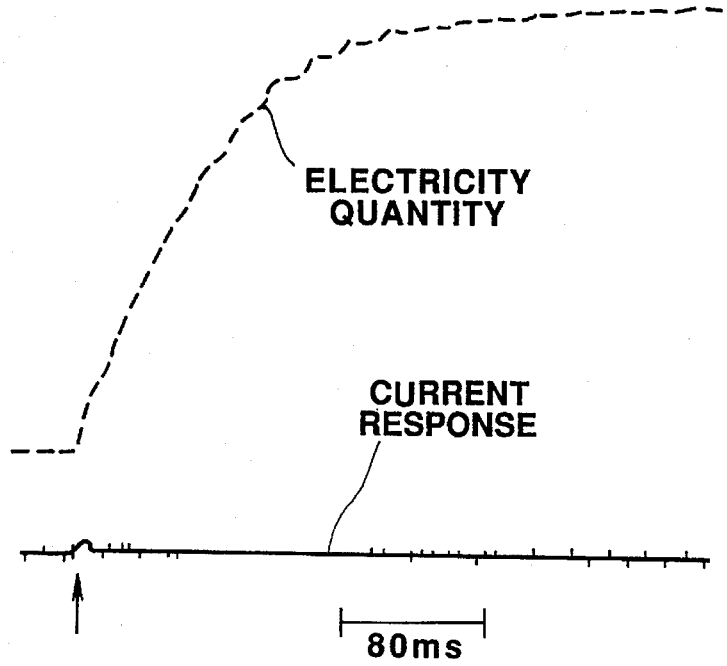
FIG. 10 is a graph showing a transient response of Example 1.

With an applied voltage of −1200 V, the transient response of current at the instant when the contact charger member was contacted with the object was observed. The response curve is shown in FIG. 10 wherein the position of an arrow represents the instant of contact. A solid line curve represents the value of conducting current and a broken line curve represents the quantity of electricity transferred as obtained by integrating current values.

Comparative Example 1

A plate-shaped contact charger member was fabricated by blending butadiene rubber with conductive carbon and forming the conductive rubber into a strip having an electric resistance of area of $10^3$ Ω.cm$^2$. The conductive rubber strip was coated by dipping it in a conductive composition in the form of a one-part urethane solution having carbon dispersed therein, thereby forming on the conductive rubber strip a conductive protective coating having an electric resistance of area of $10^8$ Ω.cm$^2$. This conductive rubber strip had an electric resistance of area of $2\times10^7$ Ω.cm$^2$ and a capacitance of $2\times10^{-18}$ F/μm$^2$. The strip was cut to a plaque of 20×20 mm. The plaque was attached to an aluminum substrate with a conductive double-side adhesive tape, obtaining the plate-shaped contact charger member.

Using this contact charger member, a charging test was carried out as in Example 1. The results are shown in FIG. 9. In this charging test, $(\epsilon_0/C_1+\epsilon_0/C_2)$ was equal to 12.2 and the maximum permissible applied voltage $|V_T|$ was about 695 V as calculated from formula (1).

Figure 11:
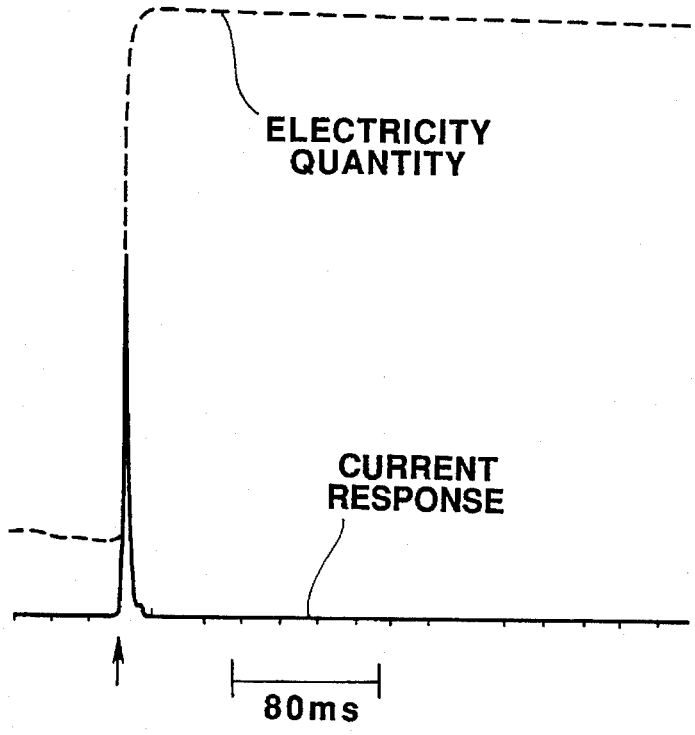
FIG. 11 is a graph showing a transient response of Comparative Example 1.

With an applied voltage of −1500 V, the transient response of current was observed as in Example 1. The response curve is shown in FIG. 11.

As seen from FIG. 9, a charging threshold or charging onset voltage of about −700 V was observed in Comparative Example 1, which well corresponded to the calculated maximum permissible applied voltage of 695 V. Therefore, charging took place through an air discharge process in Comparative Example 1, during which ozone generated. Also the transient response of FIG. 11 shows that a peaking current which was believed due to discharge occurred at the instant of contact, proving the generation of air discharge.

In contrast, in Example 1 having a calculated maximum permissible applied voltage of 1496 V, it was observed that charging began at an applied voltage of about −100 V and that a great charged potential of about −750 V was obtained with an applied voltage of −1200 V as seen from FIG. 9. Therefore, in Example 1, charging took place through a charging mode other than air discharge, probably through a direct charge transfer mode and no ozone generated during the charging process. The transient response of FIG. 10 shows that no peaking current due to discharge occurred at the instant of contact and the quantity of electricity transferred gradually increased with the lapse of time. This also proves that charging took place through a charging mode other than air discharge, probably through a direct charge transfer mode.

Benefits of Example 1 within the scope of the invention are that no air discharge occurs, ozone generation is thus eliminated, and a greater charged potential is obtained with a lower applied voltage than in Comparative Example 1 utilizing air discharge.

Example 2

A roller-shaped charger member was fabricated by adding 20 parts by weight of polyaniline powder to 100 parts by weight of soluble nylon in methanol and mixing the ingredients in a Red Devil to form a dispersion. A conductive polyurethane foam roller was dipped in the dispersion and dried, forming a skin layer of 50 μm thick on the roller.

The charger member was measured for work function and capacitance and evaluated for charging ability. The results are shown in Table 1. The work function was determined by scanning the charger member and the object to be charged with ultraviolet radiation having an excitation energy varying from a low to high level, and detecting photoelectrons emitted from their surfaces due to photoelectric effect, the energy at the onset of photoelectron emission giving the work function. The charging ability was evaluated by using an organic photoconductor (OPC) drum having a work function of 5.17 eV and a capacitance of $1\times10^{-18}$ F/μm$^2$ as the object to be charged in the arrangement shown in FIG. 6, rotating the charger member and the OPC drum in opposite directions, applying therebetween a DC voltage of −0.75 kV with an overlapping AC voltage of 1.5 kV, thereby charging the OPC drum negative, and measuring the charged potential of the OPC drum.

Example 3

A charger member was fabricated by the same procedure as in Example 2 except that 30 parts by weight of undoped $SnO_2$ powder was added instead of the polyaniline powder. The charger member was examined for work function, capacitance and charging ability as in Example 2. The results are shown in Table 1.

Example 4

A charger member was fabricated by the same procedure as in Example 2 except that 30 parts by weight of N,N'-di-β-naphthyl-p-phenylenediamine (DNPD) powder was added instead of the polyaniline powder. The charger member was examined for work function, capacitance and charging ability as in Example 2. The results are shown in Table 1.

Comparative Example 2

A charger member was fabricated by the same procedure as in Example 2 except that 30 parts by weight of MgO powder was added instead of the polyaniline powder. The charger member was examined for work function, capacitance and charging ability as in Example 2. The results are shown in Table 1.

Comparative Example 3

A charger member was fabricated by the same procedure as in Example 2 except that 30 parts by weight of ZnO powder was added instead of the polyaniline powder. The charger member was examined for work function, capacitance and charging ability as in Example 2. The results are shown in Table 1.

TABLE 1

| | Skin layer material | Work function (eV) | Capacitance (F/μm$^2$) | Charged potential (V) |
|---|---|---|---|---|
| Example 2 | polyaniline/nylon | 4.78 | $3.6\times10^{-20}$ | −670 |
| Example 3 | undoped $SnO_2$/nylon | 5.06 | $1.0\times10^{-20}$ | −660 |
| Example 4 | DNPD/nylon | 5.06 | $9.9\times10^{-19}$ | −690 |
| Comparative Example 2 | MgO/nylon | 5.71 | $3.2\times10^{-20}$ | −340 |
| Comparative Example 3 | ZnO/nylon | 5.49 | $8.9\times10^{-19}$ | −370 |

*OPC work function = 5.17 eV
capacitance = $1\times10^{-18}$ F/μm$^2$

Example 5

A roller-shaped charger member was fabricated by adding 30 parts by weight of MgO powder to 100 parts by weight of soluble nylon in methanol and mixing the ingredients in a Red Devil to form a dispersion. A conductive polyurethane foam roller was dipped in the dispersion and dried, forming a skin layer of 50 μm thick on the roller.

The charger member was measured for work function and capacitance and evaluated for charging ability. The results are shown in Table 2. The work function was determined as in Example 2. The charging ability was evaluated by using an organic photoconductor (OPC) drum having a work function of 5.24 eV and a capacitance of $1.9\times10^{-18}$ F/μm$^2$ as the object to be charged in the arrangement shown in FIG. 6, rotating the charger member and the OPC drum in opposite directions, applying therebetween a DC voltage of +0.75 kV with an overlapping AC voltage of 1.5 kV, thereby charging the OPC drum positive, and measuring the charged potential of the OPC drum.

Example 6

A charger member was fabricated by the same procedure as in Example 5 except that 30 parts by weight of N,N'-di-β-naphthyl-p-phenylenediamine (DNPD) powder was added instead of the MgO powder. The charger member was examined for work function, capacitance and charging ability as in Example 5. The results are shown in Table 2.

Comparative Example 4

A charger member was fabricated by the same procedure as in Example 5 except that 30 parts by weight of ZnO powder was added instead of the MgO powder. The charger member was examined for work function, capacitance and charging ability as in Example 5. The results are shown in Table 2.

TABLE 2

| | Skin layer material | Work function (eV) | Capacitance (F/μm$^2$) | Charged potential (V) |
|---|---|---|---|---|
| Example 5 | MgO/nylon | 5.71 | $3.2\times10^{-20}$ | +415 |
| Example 6 | ZnO/nylon | 5.49 | $8.9\times10^{-19}$ | +400 |
| Comparative Example 4 | DNPD/nylon | 5.06 | $9.9\times10^{-19}$ | +150 |

*OPC work function = 5.24 eV
capacitance = $1.9\times10^{-18}$ F/μm$^2$

As seen from Tables 1 and 2, the charger member and charging apparatus according to the present invention can provide a greater charged potential or a higher degree of charging. Since Examples 2 to 6 satisfy the relationship of formula (1), charging takes place in the direct charge injection mode. By combining the direct charge injection mode with the control of work function, a significantly greater charged potential is achieved.

Copying machines were fabricated by incorporating the charging apparatus of Examples 2 to 6 and operated a number of duplication cycles. There were obtained clear images without black peppers or fog.

Example 7

A polyurethane foam was prepared by thoroughly agitating 100 parts by weight of polyether polyol, 25 parts by weight of urethane-modified 4,4'-diphenylmethane diisocyanate (MDI), 2.5 parts by weight of 1,4-butane diol, 1.5 parts by weight of a silicone surfactant, 0.5 parts by weight of nickel acetylacetonate and 30 parts by weight of natural graphite for 2 minutes, and curing the mixture at 80° C. for 10 minutes. The polyurethane foam was cut to a plate of 20×20×3 mm, which was used as a charger member.

This charger member was evaluated for charging ability. The object to be charged was a photoconductor of polyvinyl carbazole. The charger member was placed in abutment with the object and voltage was applied between the member and the object. The applied voltage was gradually increased from 0 V while the charged potential of the object was measured. The results are shown in FIG. 12.

Figure 12:
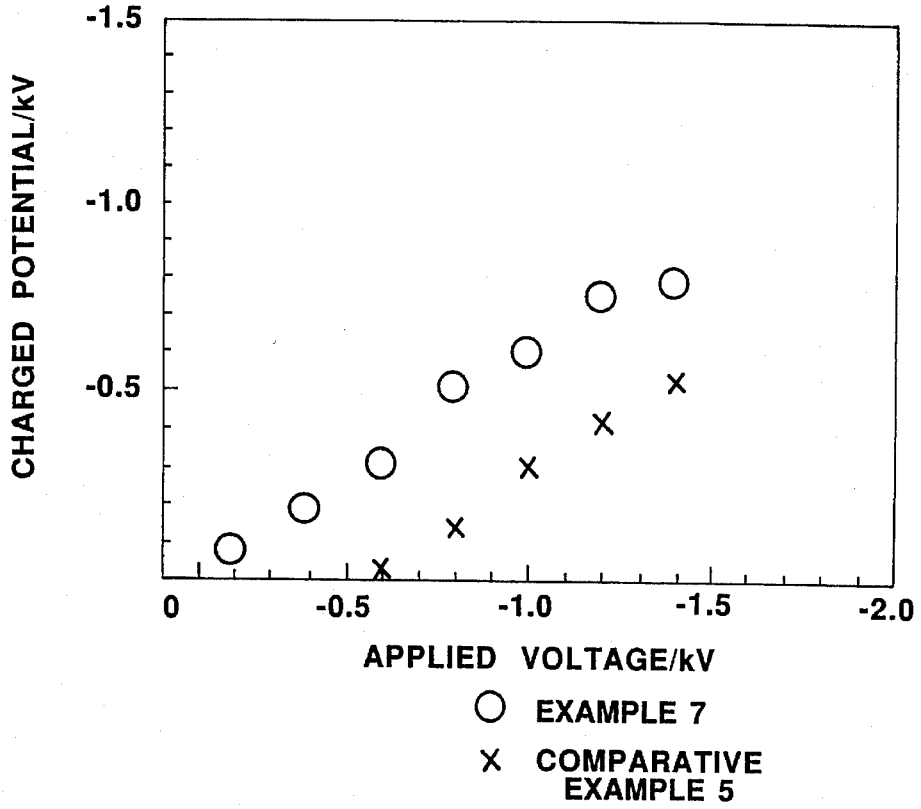
FIG. 12 is a diagram showing the charged potential vs applied voltage of a charging test in Example 7 and Comparative Example 5.

As seen from FIG. 12, this charger member had a charging threshold of about 200 V which was extremely lower than 500 V, and a satisfactory charged potential of −400 V was obtained with an applied voltage of about 700 V. Upon observation of the current during the charging test using an oscilloscope, no sparking current inherent to air discharge was detected. No ozone generation was acknowledged during the test.

Comparative Example 5

A charger member was fabricated as in Example 7 except that a butadiene rubber having 10% by weight of carbon blended therein was used. It was evaluated as in Example 7. The results are shown in FIG. 12.

As seen from FIG. 12, this comparative charger member had a charging threshold of about 600 V which was higher than 500 V. To provide a charged potential equivalent to that of Example 7, a substantially higher applied voltage is necessary than in Example 7. Upon observation of the current during the charging test using an oscilloscope, sparking current inherent to air discharge was detected. Ozone generation was detected during the test.

Example 8

A polyaniline powder was prepared by furnishing an aqueous solution containing 0.4 mol/liter of aniline, 1.0 mol/liter of $H_2SO_4$ and 0.5 mol/liter of ammonium persulfate and polymerizing aniline in accordance with a chemical oxidative polymerization technique. The polyaniline was adjusted neutral with NaOH, washed with water, and dried, obtaining polyaniline particles having a particle size of about 1 μm.

To 100 parts by weight of soluble nylon in methanol was added 50 parts by weight of the polyaniline powder. The mixture was agitated with a Red Devil to form a solution. A polyurethane roll having a volume resistivity of $10^7$ Ω.cm was dipped in the solution and dried, thereby fixing a polyaniline/nylon composite layer to the polyurethane roll surface. A roll-shaped charger member was fabricated in this way.

A charging test was carried out by placing the charger member in contact with a photoconductor drum, rotating them, and applying a DC voltage of −1.2 kV therebetween. The photoconductor drum on the surface was evenly charged to −455 V.

Example 9

The polyaniline obtained as in Example 8 was fully reduced with hydrazine and then dissolved in N-methylpyrrolidone. A polyurethane roll as used in Example 8 was dipped in the solution and dried, thereby fixing a polyaniline layer to the polyurethane roll surface. A roll-shaped charger member was fabricated in this way.

A charging test was carried out on this charger member as in Example 8. The photoconductor drum on the surface was evenly charged to −370 V.

Comparative Example 6

Using a polyurethane roll as used in Examples 8 and 9 as the charger member without further treatment, a charging test was carried out as in Examples 8 and 9. The photoconductor drum was little charged.

Example 10 & Comparative Example 7

Composite polyurethane bodies having varying volume resistivity were prepared by using a polyether polyol in the form of glycerine having propylene oxide and ethylene oxide added thereto as a compound having at least two active hydrogen atoms, a urethane-modified MDI as a compound having at least two isocyanate groups, and adding 15 to 23% by weight of graphite. As the polymerization aids, a silicone surfactant, dibutyltin laurate or the like was used as the case might be. Curing was at 80° C. for 20 minutes.

A charging test was carried out on each polyurethane composite charger member by placing the charger member in contact with a photoconductor drum, rotating them, and applying a DC voltage of 1.2 kV therebetween. The charged potential was plotted relative to the volume resistivity, obtaining FIG. 13.

Figure 13:
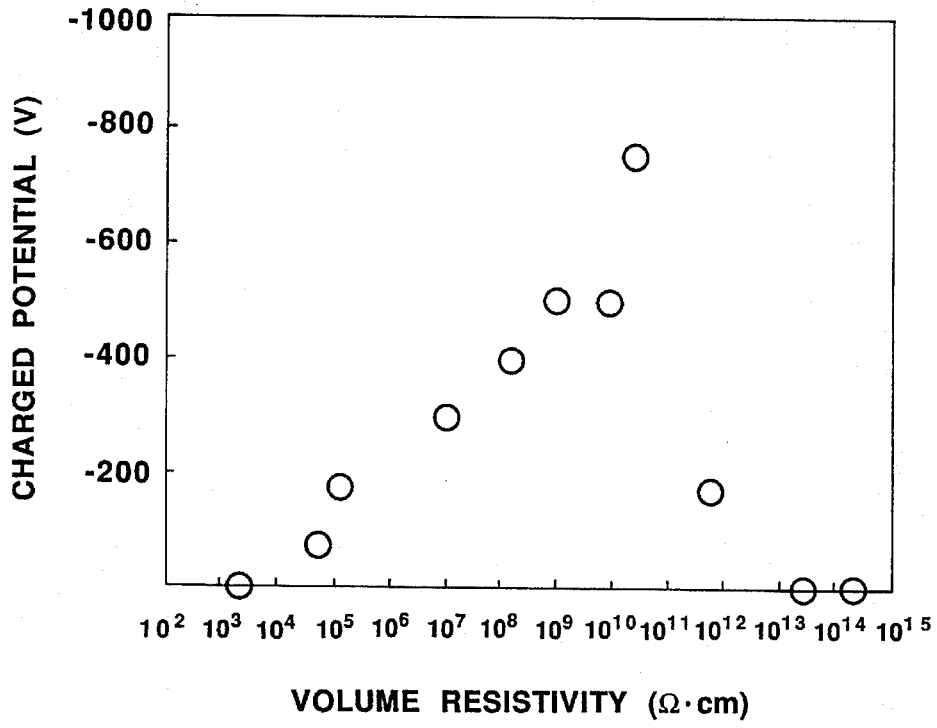
FIG. 13 is a diagram showing the charged potential vs volume resistivity of a charging test in Example 10.

As seen from FIG. 13, those charger members having a volume resistivity in the range of $10^4$ to $10^{12}$ Ω.cm according to the present invention provide a greater charged potential and better charging performance than the charger members having a volume resistivity outside the range.

We claim:

1. A contact charging method comprising the steps of:

placing a contact charger member in abutment with an object to be charged, and applying voltage between the contact charger member and the object for electrically charging the object, wherein the capacitance of the contact charger member, the capacitance of the object to be charged, and the applied voltage meet the following equation:

$$|V_T| < 312 + 6.2\left(\frac{\epsilon_0}{C_1} + \frac{\epsilon_0}{C_2}\right) + 87.96\sqrt{\left(\frac{\epsilon_0}{C_1} + \frac{\epsilon_0}{C_2}\right)} \quad (1)$$

wherein $C_1$ is the capacitance of the contact charger member ($F/\mu m^2$), $C_2$ is the capacitance of the object ($F/\mu m^2$), $V_T$ is the applied voltage (V), and $\epsilon_0$ is the dielectric constant of vacuum equal to $8.854\times 10^{-18}$ F/μm.

2. A contact charging apparatus for electrically charging an object, comprising a contact charger member disposed in abutment with a surface of the object to be charged, and means for applying voltage between the contact charger member and the object for electrically charging the object, wherein the capacitance of the contact charger member, the capacitance of the object to be charged, and the applied voltage meet the following equation:

$$|V_T| < 312 + 6.2\left(\frac{\epsilon_0}{C_1} + \frac{\epsilon_0}{C_2}\right) + 87.96\sqrt{\left(\frac{\epsilon_0}{C_1} + \frac{\epsilon_0}{C_2}\right)} \quad (1)$$

wherein $C_1$ is the capacitance of the contact charger member ($F/\mu m^2$), $C_2$ is the capacitance of the object ($F/\mu m^2$), $V_T$ is the applied voltage (V), and $\epsilon_0$ is the dielectric constant of vacuum equal to $8.854\times 10^{-18}$ F/μm.

3. A charging apparatus according to claim 2, wherein when said charger member is used to negatively charge said object, at least a portion of the charger member which is in abutment with the object to be charged has a lesser work function than the surface of the object.

4. A charging apparatus according to claim 2, wherein when said charger member is used to positively charge said object, at least a portion of the charger member which is in abutment with the object to be charged has a greater work function than the surface of the object.

5. A charging apparatus according to claim 3, wherein said charger member comprises a charger roll and said object to be charged comprises a photoconductor.

6. A charging apparatus according to claim 4, wherein said charger member comprises a charger roll and said object to be charged comprises a photoconductor.

7. A charging apparatus according to claim 2, wherein the charger member has a charging threshold of up to 500 V as expressed in the applied voltage.

8. A charger member for use in electrically charging an object by placing the charger member in abutment with the object to be charged and applying voltage therebetween, wherein a conductive polymer is distributed at the abutment with the object, said conductive polymer being one of the group consisting of polyaniline, polypyrrole, polyfuran, polybenzene, and polyphenylene sulfide, and wherein at least a portion of the charger member which is in abutment with the object to be charged predominantly comprises a polyurethane having a volume resistivity of $10^4$ to $10^{12}$ Ω.cm, said conductive polymer being disposed on said polyurethane.

9. A charging apparatus for electrically charging an object, comprising:

a charger member disposed in abutment with a surface of the object to be charged, and means for applying voltage between the charger member and the object for charging the object, wherein a conductive polymer is distributed at the abutment with the object, said conductive polymer being one of the group consisting of polyaniline, polypyrrole, polyfuran, polybenzene, and polyphenylene sulfide, and wherein at least a portion of the charger member which is in abutment with the object to be charged predominantly comprises a polyurethane having a volume resistivity of $10^4$ to $10^{12}$ Ω.cm, said conductive polymer being disposed on said polyurethane.

10. A method as recited in claim 1, wherein electric charges are directly injected into the object without air discharge.

11. An apparatus as recited in claim 2, wherein electric charges are directly injected into the object without air discharge.

12. A method as recited in claim 1, wherein said object is negatively charged during the applying step, and wherein at least a portion of the charger member which is in abutment with the object to be charged has a lesser work function than the surface of the object.

13. A method as recited in claim 1, wherein said object is positively charged during the applying step, and wherein at least a portion of the charger member which is in abutment with the object to be charged has a greater work function than the surface of the object.

14. An apparatus as recited in claim 2, wherein said object is negatively charged, and wherein at least a portion of the charger member which is in abutment with the object to be charged has a lesser work function than the surface of the object.

15. An apparatus as recited in claim 2, wherein said object is positively charged, and wherein at least a portion of the charger member which is in abutment with the object to be charged has a greater work function than the surface of the object.

16. A charger roll as recited in claim 3, wherein at least a portion of the charger roll predominantly comprises a polyurethane having a volume resistivity of $10^4$ to $10^{12}$ Ω.cm.

17. A charger roll as recited in claim 4, wherein at least a portion of the charger roll predominantly comprises a polyurethane having a volume resistivity of $10^4$ to $10^{12}$ Ω.cm.

18. A charger roll as recited in claim 5, wherein at least a portion of the charger roll predominantly comprises a polyurethane having a volume resistivity of $10^4$ to $10^{12}$ Ω.cm.

19. A charger roll as recited in claim 6, wherein at least a portion of the charger roll predominantly comprises a polyurethane having a volume resistivity of $10^4$ to $10^{12}$ Ω.cm.

* * * * *